US005802871A

United States Patent [19]

Howard et al.

[11] Patent Number: 5,802,871

[45] Date of Patent: Sep. 8, 1998

[54] DEPHLEGMATOR PROCESS FOR NITROGEN REMOVAL FROM NATURAL GAS

[75] Inventors: Lee Jarvis Howard, Pikeville; Howard Charles Rowles, Center Valley, both of Pa.

[73] Assignee: Air Products and Chemicals, Inc., Allentown, Pa.

[21] Appl. No.: 951,705

[22] Filed: Oct. 16, 1997

[51] Int. Cl.[6] ..... F25J 1/00

[52] U.S. Cl. ..... 62/627; 62/927

[58] Field of Search ..... 62/627, 927

[56] References Cited

U.S. PATENT DOCUMENTS

| | | | |
|---|---|---|---|
| 4,002,042 | 1/1977 | Pryor et al. | 62/627 |
| 4,270,939 | 6/1981 | Rowles et al. | 62/22 |
| 4,270,940 | 6/1981 | Rowles et al. | 62/28 |
| 4,352,685 | 10/1982 | Swallow | 62/28 |
| 4,411,677 | 10/1983 | Pervier et al. | 62/25 |
| 4,415,345 | 11/1983 | Swallow | 62/28 |
| 4,501,600 | 2/1985 | Pahade | 62/28 |
| 4,519,825 | 5/1985 | Bernhard et al. | 62/28 |
| 4,588,427 | 5/1986 | Yao et al. | 62/17 |
| 4,592,767 | 6/1986 | Pahade et al. | 62/31 |
| 4,623,371 | 11/1986 | Mehra | 62/17 |
| 4,662,919 | 5/1987 | Davis | 62/25 |
| 4,664,686 | 5/1987 | Pahade et al. | 62/24 |
| 4,680,042 | 7/1987 | Mehra | 62/17 |
| 4,714,487 | 12/1987 | Rowles | 62/24 |
| 4,720,293 | 1/1988 | Rowles et al. | 62/24 |
| 4,720,294 | 1/1988 | Lucadamo et al. | 62/31 |
| 4,732,598 | 3/1988 | Rowles et al. | 62/28 |
| 4,746,342 | 5/1988 | DeLong et al. | 62/24 |
| 4,749,393 | 6/1988 | Rowles et al. | 62/24 |
| 4,767,428 | 8/1988 | Apffel | 62/24 |
| 4,778,498 | 10/1988 | Hanson et al. | 62/28 |
| 4,805,413 | 2/1989 | Mitchell et al. | 62/24 |
| 4,878,932 | 11/1989 | Phade et al. | 62/24 |
| 4,883,514 | 11/1989 | Mehra | 62/17 |
| 4,921,514 | 5/1990 | Rowles et al. | 62/24 |
| 5,017,204 | 5/1991 | Gottier et al. | 62/11 |
| 5,026,408 | 6/1991 | Saunders et al. | 62/24 |
| 5,041,149 | 8/1991 | Handley | 62/11 |
| 5,051,120 | 9/1991 | Pahade et al. | 62/24 |
| 5,287,703 | 2/1994 | Bernhard et al. | 62/24 |
| 5,375,422 | 12/1994 | Butts | 62/24 |
| 5,461,870 | 10/1995 | Paradowski | 62/11 |
| 5,505,049 | 4/1996 | Coyle et al. | 62/11 |
| 5,596,883 | 1/1997 | Bernhard et al. | 62/618 |
| 5,617,741 | 4/1997 | McNeil et al. | 62/622 |

OTHER PUBLICATIONS

Bernhard, D.P. et al., "Recovery of Valuable Hydrocarbons Using Dephlegmator Technology", *Advances in Cryogenic Engineering*, vol. 33, 1988, pp. 983–989.

"Consider Small Nitrogen Rejection Units", *Hydrocarbon Processing*, May 1986, pp. 41–42.

Vines, H.L., "Upgrading Natural Gas", *Chemical Engineering Progress*, Nov. 1986, pp. 46–50.

Butts, R. C., "Nitrogen–Rejection Process Developed for Small Fields", *Oil & Gas Journal*, Mar. 13, 1995, pp. 92–94.

Lugosch, P.E., "Specifying the Nitrogen Rejection Unit", Presented at AIChE 1988 Spring National Meeting, New Orleans, LA, Mar. 6–10, 1988.

*Primary Examiner*—Ronald C. Capossela

*Attorney, Agent, or Firm*—John M. Fernbacher

[57] ABSTRACT

Nitrogen is removed from a pressurized feed gas mixture containing nitrogen and methane by cooling, partial condensation, and rectification in one or more dephlegmators. Autorefrigeration is provided by pressure letdown of selected process streams and external refrigeration is not required.

19 Claims, 3 Drawing Sheets

DEPHLEGMATOR PROCESS FOR NITROGEN REMOVAL FROM NATURAL GAS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Gas produced from many natural gas fields contains nitrogen as a diluent, along with other components which may include light hydrocarbons, helium, carbon dioxide, hydrogen sulfide, and water. Nitrogen often is present at concentrations greater than 5 mole %, and since typical natural gas pipeline specifications require nitrogen concentrations well below 5 mole %, nitrogen removal is required. The higher-boiling components in natural gas are removed by known methods to yield a pretreated natural gas stream containing predominantly nitrogen and methane.

Numerous processes have been developed and commercialized to remove excess nitrogen from such a pretreated natural gas stream to meet pipeline specifications, and most of these processes operate at cryogenic temperatures and utilize distillation columns to perform the key methane-nitrogen separation.

U.S. Pat. Nos. 5,375,422, 5,257,505, 5,141,544, 5,041,149, 5,026,408, and 4,878,932 disclose single distillation column processes to remove nitrogen from nitrogen-containing natural gas streams. Most of these processes require very high feed gas pressures (600 psia or more) or utilize cryogenic pumps in order to reduce the power required to recompress the separated methane-rich gas to pipeline pressure. A single distillation column process with an open loop recirculating fluid heat pump cycle to remove nitrogen from a nitrogen-containing natural gas stream U.S. is described in U.S. Pat. No. 4,415,345.

Single distillation column processes with closed loop recirculating fluid heat pump cycles to remove nitrogen from nitrogen-containing natural gas streams are disclosed in U.S. Pat. Nos. 4,778,498, 4,767,428, 4,662,919, 4,592,767, 4,501,600 and 4,411,677. Multiple distillation columns also can be used for this separation. Dual distillation column processes are described in U.S. Pat. Nos. 5,051,120, 4,948,405, 4,936,888, 4,710,212, 4,451,275 and 4,352,685; three or more distillation columns for this purpose are disclosed in U.S. Pat. Nos. 5,617,741, 4,805,413, 4,746,342, and 4,664,686.

U.S. Pat. No. 5,051,120 describes a cryogenic stripping column in combination with a cryogenic rectification process comprising one or more distillation columns to remove nitrogen from a nitrogen-containing natural gas stream. A dephlegmator used in combination with a cryogenic distillation column to remove nitrogen from a nitrogen-containing natural gas stream is disclosed in U.S. Pat. No. 4,732,598.

Nitrogen is removed from pressurized liquefied natural gas as described in U.S. Pat. No. 5,505,049 by cooling the liquefied gas in a passage of a refluxing heat exchanger, flashing the cooled liquid, and partially vaporizing and stripping the remaining liquid in another passage by indirect heat exchange with the cooling liquefied gas. The partial vaporization and stripping yields a reduced-pressure liquefied natural gas product and a nitrogen-enriched vapor.

Absorption processes are disclosed in U.S. Pat. Nos. 4,883,514, 4,680,042, 4,623,371, and 4,588,427 to reduce the nitrogen content of nitrogen-containing natural gas streams. Absorption processes require absorption columns, stripping columns, and recirculating solvents, and are generally inefficient for nitrogen-methane separation because of the large solvent recirculation rates required.

Most of these processes rely on cryogenic distillation columns with associated reboilers, condensers, reflux drums and other equipment which is costly and which make the process difficult to control. Many of these processes also require complex refrigeration cycles to provide necessary refrigeration. These refrigeration cycles are also costly and difficult to control, particularly when the nitrogen content of the feed gas changes.

A simplified process for removing nitrogen from natural gas without the use of distillation columns or complex refrigeration methods would be desirable in order to reduce capital and operating costs, and also to improve and simplify process operation. Such a process is disclosed in the present invention as described below and defined in the claims which follow.

BRIEF SUMMARY OF THE INVENTION

The invention is a method for the removal of nitrogen from a pressurized feed gas mixture containing nitrogen and methane which comprises (a) cooling the feed gas mixture; (b) introducing the resulting cooled feed gas mixture into a dephlegmator wherein the gas mixture is further cooled, partially condensed, and rectified to produce a nitrogen-rich overhead and a methane-rich bottoms; (c) subcooling the methane-rich bottoms and reducing the pressure of the resulting subcooled stream; (d) vaporizing the resulting reduced-pressure methane-rich stream in the dephlegmator by indirect heat exchange with the cooled feed gas mixture to provide at least a portion of the refrigeration required for cooling, partially condensing, and rectifying the cooled feed gas mixture in step (b); and (e) withdrawing from the dephlegmator an intermediate vaporized methane-rich stream.

The pressure of the pressurized feed gas mixture preferably is greater than about 250 psia and can contain between about 5 and about 15 mole % nitrogen. The subcooling of the methane-rich bottoms in step (c) can be accomplished at least in part by indirect heat exchange with the reduced-pressure methane-rich stream which is vaporized in the dephlegmator in step (d).

The invention may further comprise reducing the pressure of the nitrogen-rich overhead and warming at least a portion of the resulting reduced-pressure nitrogen-rich stream in the dephlegmator to provide by indirect heat exchange a portion of the refrigeration required for cooling, partially condensing, and rectifying the cooled feed gas mixture in step (b), and withdrawing therefrom an intermediate nitrogen-rich stream.

The intermediate nitrogen-rich stream can be warmed by indirect heat exchange with the feed gas mixture of step (a), thereby providing a portion of the refrigeration required for cooling the feed gas mixture.

Optionally, the reduced-pressure methane-rich stream of step (d) can be separated into an intermediate vapor and an intermediate liquid, and the intermediate liquid utilized to provide the portion of the resulting reduced-pressure methane-rich stream which is vaporized in step (d). The intermediate vapor may be combined with a reduced-pressure nitrogen-rich stream or a work-expanded nitrogen-rich stream, or alternatively the vapor can be warmed separately in the dephlegmator and by indirect heat exchange with the feed gas mixture in a separate heat exchanger.

Another optional embodiment comprises warming the nitrogen-rich overhead by indirect heat exchange in the dephlegmator, work-expanding the resulting warmed stream to yield a cooled nitrogen-rich overhead, and warming the resulting work-expanded nitrogen-rich overhead by indirect heat exchange in the dephlegmator, thereby providing a portion of the refrigeration required for cooling, partially condensing, and rectifying the cooled feed gas mixture in step (b), and withdrawing therefrom an intermediate nitrogen-rich stream. The intermediate nitrogen-rich stream can be warmed by indirect heat exchange with the feed gas mixture of step (a) if desired, thereby providing a portion of the refrigeration required for cooling the feed gas mixture. Optionally, the intermediate vaporized methane-rich stream withdrawn from the dephlegmator in step (e) can be warmed by indirect heat exchange with the feed gas mixture of step (a), thereby providing a portion of the refrigeration required for cooling the feed gas mixture.

The methane-rich bottoms of step (b) optionally is partially vaporized by indirect heat exchange with the cooled feed gas mixture of step (b) to yield a partially-vaporized methane-rich stream and a further cooled feed gas mixture. The partially-vaporized methane-rich stream can be separated into a vapor fraction and a liquid fraction. The further cooled feed gas mixture and the vapor fraction can be introduced into the dephlegmator, wherein the liquid fraction is subcooled according to step (c). In this option, the pressurized feed gas mixture preferably contains between about 15 and about 30 mole % nitrogen.

In another optional embodiment, the methane-rich bottoms of step (b) is partially vaporized by indirect heat exchange with the cooled feed gas mixture of step (b) in a stripping heat exchanger in which the methane-rich bottoms is stripped to yield a further-enriched methane stream and an intermediate nitrogen-enriched vapor. In this option, the cooled feed gas mixture is further cooled to yield an intermediate cooled feed gas mixture, the intermediate nitrogen-enriched vapor and the intermediate cooled feed gas are introduced into the dephlegmator, and the further-enriched methane stream is subcooled according to step (c). In this embodiment, the pressurized feed gas mixture preferably contains greater than about 30 mole % nitrogen.

The invention includes apparatus for the removal of nitrogen from a pressurized feed gas mixture containing nitrogen and methane which comprises:

(a) heat exchange means for cooling the feed gas mixture;

(b) a dephlegmator including a first flow passage for further cooling, partially condensing, and rectifying the resulting cooled feed gas mixture from the heat exchanger means to produce a nitrogen-rich overhead stream and a methane-rich bottoms, and means for introducing the cooled feed gas mixture into the first flow passage;

(c) means for withdrawing the methane-rich bottoms from the dephlegmator, means for subcooling the methane-rich bottoms, and means for reducing the pressure of the resulting subcooled stream;

(d) a second flow passage in the dephlegmator for vaporizing the reduced-pressure subcooled methane-rich stream, wherein the second flow passage is in indirect heat exchange contact with the first flow passage, and means for introducing the resulting reduced-pressure subcooled methane-rich stream into the second flow passage;

(e) means for withdrawing from the second flow passage an intermediate vaporized methane-rich stream; and (f) means for withdrawing from the first flow passage the nitrogen-rich overhead.

The apparatus can further comprise means for reducing the pressure of the nitrogen-rich overhead, a third flow passage in the dephlegmator for warming at least a portion of the resulting reduced-pressure nitrogen-rich stream, wherein the third flow passage is in indirect heat exchange contact with the first and second flow passages, means for introducing the reduced-pressure nitrogen-rich stream into the third flow passage, and means for withdrawing an intermediate nitrogen-rich stream from the third flow passage. The means for subcooling the methane-rich bottoms can comprise a fourth flow passage which is in indirect heat exchange contact with the first, second, and third flow passages of the dephlegmator.

The apparatus can further comprise heat exchange means to partially vaporize the methane-rich bottoms by indirect heat exchange with the cooled feed gas mixture, separator means to separate the resulting partially vaporized methane-rich bottoms into a vapor fraction and a liquid fraction, means to transfer the vapor fraction from the separator means into the first flow passage of the dephlegmator, and means to transfer the liquid fraction from the separator means into the fourth flow passage of the dephlegmator. In addition, the apparatus can include stripping heat exchange means wherein the methane-rich bottoms is partially vaporized and stripped by indirect heat exchange with the cooled feed gas mixture to yield a further-enriched methane liquid and an intermediate nitrogen-enriched vapor, means to transfer the further-enriched methane liquid from the stripping heat exchange means into the fourth flow passage of the dephlegmator, and means to transfer the intermediate nitrogen-enriched vapor from the stripping heat exchange means into the first flow passage of the dephlegmator.

DETAILED DESCRIPTION OF THE INVENTION

The process of this invention reduces the nitrogen content of natural gas to pipeline specification by a simple, auto-refrigerated, cryogenic separation process which does not require distillation columns, auxiliary refrigeration equipment or cryogenic pumps. The process is sufficiently flexible to process natural gas-derived streams containing 5 to 50 mole % or more of nitrogen while reducing the nitrogen content of the product natural gas to 2 to 5 mole % nitrogen. In addition, the rejected nitrogen stream will contain only 2 to 5 mole % methane, providing very high methane recovery. The process can also handle $CO_2$ concentrations in the feed gas as high as 1000 to 2000 vppm without freeze-up, depending on the hydrocarbon content of the feed gas.

Figure 1:
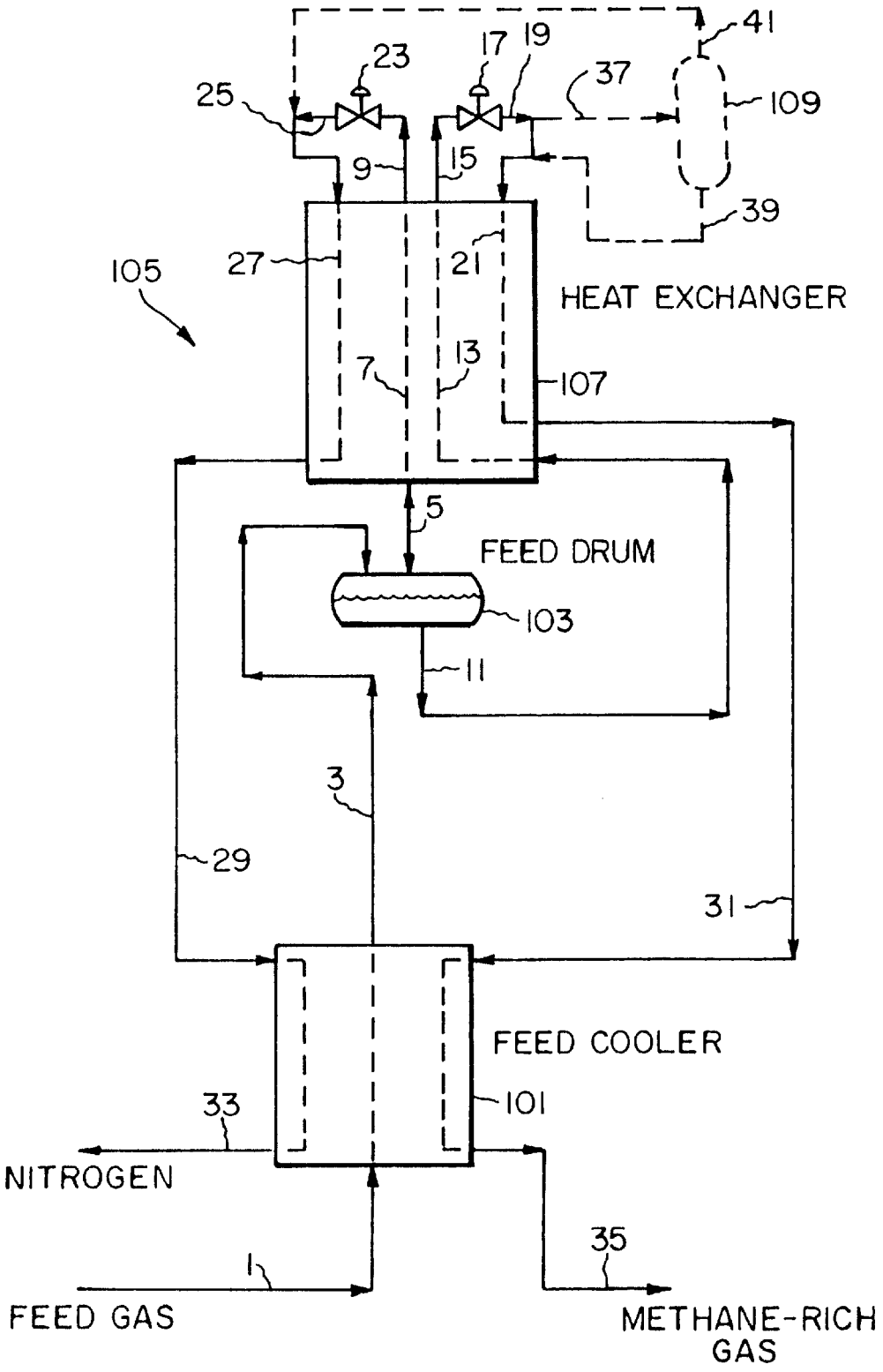
FIG. 1 is a schematic flow diagram of the process and system of the present invention.

An embodiment of the invention is shown in FIG. 1. Natural gas is pretreated by known methods remove water, acid gases such as carbon dioxide and hydrogen sulfide, and optionally a portion of the heavier hydrocarbons if present to yield feed stream 1 containing predominantly nitrogen and methane. This stream is obtained from the pretreatment step preferably at a pressure of at least 250 psia. Feed gas stream 1 is cooled in feed cooler 101 to a temperature near the hydrocarbon dew point of the feed gas mixture and cooled feed gas stream 3 passes to feed drum 103 which is part of dephlegmator 105. Cooled feed gas from feed drum 103 then passes upward through line 5 to rectifying heat exchanger 107 which is also part of dephlegmator 105.

In heat and mass transfer flow passage 7, which is representative of a plurality of related heat and mass transfer flow passages in common service, the cooled feed gas is further cooled in upward flow by indirect heat transfer against one or more warming process streams (later defined), partially condensed, and rectified to yield nitrogen-rich overhead stream 9 and a methane-rich liquid which flows downward through passage 7 and line 5 into feed drum 103. Methane-rich liquid bottoms stream 11 is withdrawn therefrom. In heat and mass transfer flow passage 7, in a manner characteristic of dephlegmator operation, simultaneous heat and mass transfer occur in which condensing liquid flows downward against upward-flowing noncondensed vapor, and rectification occurs to an extent which is equivalent to about 5 to 15 theoretical equilibrium stages of separation.

In the present specification, dephlegmator 105 is defined as the combination of rectifying heat exchanger 107 and feed drum 103 along with associated piping and valves. Rectifying heat exchanger 107 itself is often described in the art as a dephlegmator or refluxing heat exchanger.

Rectifying heat exchanger 107 typically is a brazed core-type plate and fin heat exchanger fabricated of aluminum or stainless steel. This type of heat exchanger, which is known in the art, contains a plurality of flow passages arranged in groups, each group of which operates in heat transfer or heat and mass transfer service for an individual process stream. Each group of flow passages is in indirect heat exchange relation with other groups of passages, and heating and cooling of multiple process streams occurs by indirect heat transfer among the groups of passages. Each group of passages is isolated from the others with respect to fluid flow, and vapor-liquid mass transfer can occur for a given process stream within a given group of passages. Each of the flow passages 7, 13, 21, and 27 of FIG. 1 is representative of a group of flow passages containing a common process fluid. In some flow passages no phase change occurs, while in others phase change occurs. Phase change can occur in a flow passage in which both phases flow cocurrently, and a stream can be totally or partially condensed or vaporized therein. Alternatively, phase change can occur in a flow passage in which vapor and liquid flow countercurrently such that rectification or vapor-liquid mass transfer occurs. Upward-flowing vapor is enriched in the more volatile components in the stream while the downward-flowing liquid is enriched in the less volatile components in the stream. A dephlegmator typically provides the equivalent of 5 to 15 theoretical equilibrium stages of separation or rectification.

In the present disclosure, the terms rectify or rectification mean the separation of a mixture by vapor-liquid phase change with accompanying vapor-liquid mass transfer and heat transfer over a continuous range of temperatures. No individual stages containing mass transfer devices are used, and mass transfer occurs during rectification with continuous vapor-liquid contact.

At least a portion of methane-rich liquid bottoms stream 11 is subcooled in representative passage 13 of heat exchanger 107, subcooled liquid stream 15 is flashed across valve 17 to a lower pressure, and the resulting flashed stream 19 is vaporized in representative flow passage 21 of heat exchanger 107. This vaporization in flow passage 21 provides, by indirect heat transfer, most of the refrigeration required for cooling the process streams in heat exchanger 107. The nitrogen-rich overhead stream 9 is reduced in pressure across throttling valve 23 and reduced-pressure nitrogen-enriched stream 25 is warmed in flow passage 27 in heat exchanger 107 to provide a portion of the refrigeration required for cooling process streams in passages 7 and 13. Alternatively, the pressure of stream 9 can be reduced by work expansion.

Nitrogen-rich stream 29 and methane-rich stream 31 from heat exchanger 107 are further warmed in feed cooler 101 thereby cooling feed gas stream 1 as earlier described. Warmed nitrogen-rich gas stream 33 can be utilized for other purposes, for example the regeneration of upstream feed gas dryers (not shown). Methane-rich product gas stream 35 is compressed (not shown) to pipeline pressure, typically 300 to 1000 psia. This is the only compression required by the process of FIG. 1 as long as feed gas stream 1 is above about 250 psia. This embodiment of the invention can typically be used when the nitrogen content of feed gas stream 1 is in the range of 5 to about 15 mole %.

Optionally flashed stream 19 generated by pressure let-down of subcooled methane-rich liquid stream 15 can be introduced as stream 37 into vapor-liquid separator 109 to yield methane-rich liquid stream 39, which enters flow passage 21, and nitrogen-rich vapor stream 41, which is combined with reduced-pressure nitrogen-enriched stream 25 and warmed in flow passage 27. This option further reduces the nitrogen content of methane-rich gas stream 35.

Figure 2:
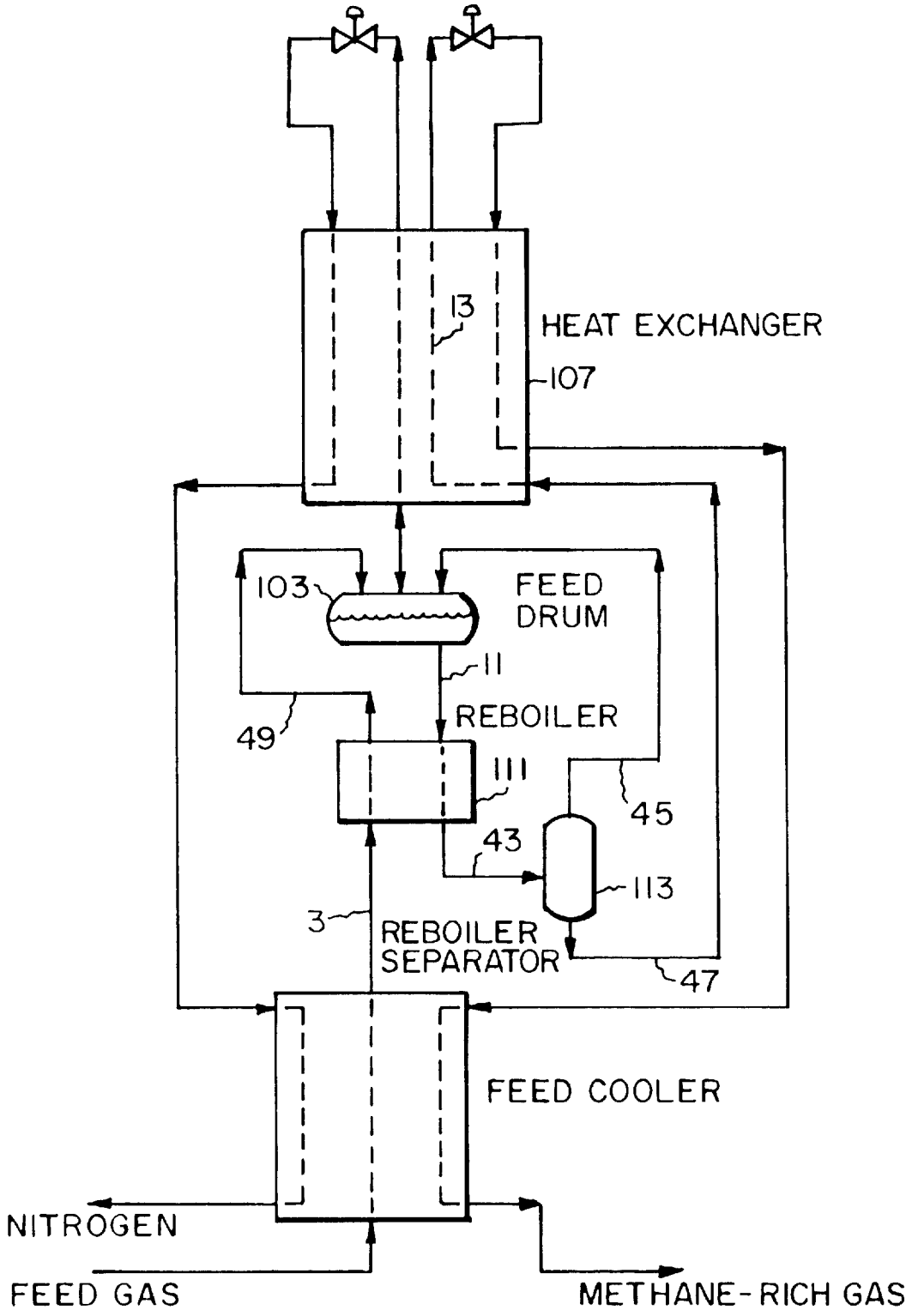
FIG. 2 is a schematic flow diagram of an alternative embodiment of the process and system of the present invention.

Another embodiment of the invention is shown in FIG. 2 which can be used if further removal of nitrogen from the methane-rich liquid is required. In this embodiment, at least a portion of methane-rich liquid bottoms stream 11 is partially vaporized in single-stage reboiler 111 by indirect heat exchange with cooled feed gas stream 3 to yield mixed phase stream 43 which flows into phase separator 113. Nitrogen-enriched vapor stream 45 is withdrawn therefrom and returned to dephlegmator feed drum 103, and methane-enriched liquid stream 47 is withdrawn and returned to flow passage 13 of heat exchanger 107 for subcooling as earlier described. Further cooled feed gas stream 49 is withdrawn therefrom and returned to dephlegmator feed drum 103 for rectification as earlier described. This embodiment of the invention preferably is used when the nitrogen content of feed gas stream 1 is in the range of about 15 to 30 mole %.

Figure 3:
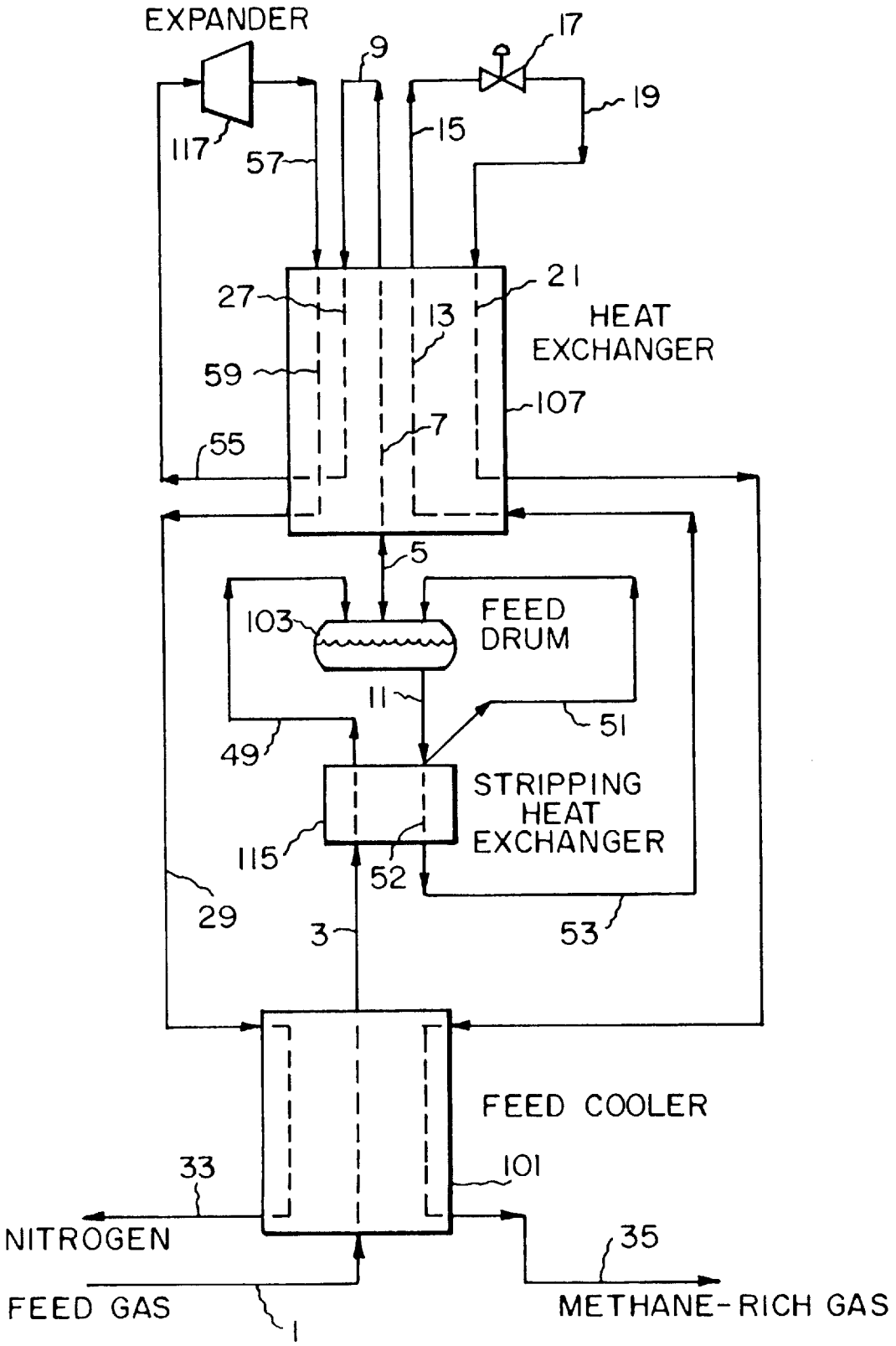
FIG. 3 is a schematic flow diagram of another alternative embodiment of the process and system of the present invention.

Another alternative embodiment of the invention is shown in FIG. 3, wherein at least a portion of methane-rich liquid bottoms stream 11 is introduced into stripping heat exchanger 115, which is a multi-stage plate-fin stripping heat exchanger as described in U.S. Pat. No. 5,596,883. The methane-rich liquid is warmed and partially vaporized therein by indirect heat exchange with cooled feed gas stream 3. In this exchanger, the methane-rich liquid partially vaporizes as it flows downward through flow passage 52 and exchanges mass with the resulting upward-flowing nitrogen-enriched vapor, which is then withdrawn at the top of the exchanger. Stripped nitrogen-enriched vapor stream 51 is returned to dephlegmator feed drum 103 for rectification as earlier described. At least a portion of stripped methane-rich liquid stream 53 is subcooled in flow passage 13 of heat exchanger 107 as earlier described. This embodiment of the invention is particularly useful when the nitrogen content of feed gas stream 1 is more than about 30 mole %.

Optionally, reboiler 111 or stripping heat exchanger 115 can be incorporated into feed cooler 101, rather than provided as a separate heat exchange unit. In either case, the heat required for the stripping process preferably is provided by indirect heat exchange with feed gas stream 1. The reboiler separator 113 in the embodiment of FIG. 2 can also be incorporated into the feed drum 103, rather than provided as a separate drum.

In another optional mode of operation, when feed gas stream 1 contains higher concentrations of $C_2^+$ or $C_3^+$ a second dephlegmator can be installed between feed cooler 101 and dephlegmator 107 to recover and rectify these $C_2^+$ or $C_3^+$ hydrocarbons.

Instead of throttling across valve 23 of FIG. 1, nitrogen-rich overhead stream 9 can be warmed in flow passage 27 as shown in FIG. 3 without pressure reduction to yield warmed nitrogen-rich stream 55, which is work-expanded in expander 117. The resulting cooled nitrogen-rich stream 57 is introduced into flow passage 59 to provide refrigeration for cooling process streams in flow passages 7 and 13. This option utilizing expander 117 can be used with any of the embodiments of FIGS. 1–3.

EXAMPLE

An example of the process of the present invention uses the embodiment shown in FIG. 3. Feed gas stream 1 at a flow rate of 825 lbmoles per hour contains 38.2 mole % nitrogen, 61.8 mole % methane and less than 0.05 mole % ethane and heavier hydrocarbons ($C_2^+$) at 100° F. and 290 psia. The stream is cooled in feed cooler 101 and stripping heat exchanger 115, and cooled feed stream 49 at −185° F. is introduced into feed drum 103 where any condensed liquid is separated. Uncondensed feed vapor and nitrogen-enriched stripped vapor stream 51 from stripping heat exchanger 115 are combined and further cooled to −250° F. in flow passage 7 of heat exchanger 107 to condense and rectify a methane-enriched liquid which is returned to feed drum 103 via line 5. Methane-enriched liquid stream 11 from feed drum 103, at a flow rate of 689 lbmoles per hour containing 89.1 mole % methane, is warmed and partially vaporized in stripping heat exchanger 115.

Stripped nitrogen-enriched vapor stream 51, at a flow rate of 164 lbmoles per hour containing 33.2 mole % nitrogen, is returned to feed drum 103 for rectification in heat exchanger 107 as earlier described. Stripped methane-rich liquid stream 53, at a flow rate of 525 lbmoles per hour containing 96.1 mole % methane at −171° F., is subcooled in flow passage 13 of heat exchanger 107 to yield subcooled methane-rich liquid 15 at −250° F. This stream is throttled across valve 17 to 30 psia and the resulting reduced-pressure methane-rich stream 19 is warmed and vaporized in flow passage 21 to supply refrigeration for heat exchanger 107 and feed cooler 101 before recovery as methane-rich product stream 35 at about 25 psia.

Overhead vapor stream 9 at a flow rate of 300 lbmoles per hour containing 98.1 mole % nitrogen at −250° F. is reheated to −185° F. in flow passage 27 of heat exchange 107, work expanded through expander 117, and expanded stream 57 at −304° F. and 25 psia is warmed in flow passage 59 of heat exchanger 107 and in feed cooler 101 to provide additional refrigeration for the process.

In this example, 99% of the methane in nitrogen-containing gas feed stream 1 is recovered in methane-rich gas product stream 35. About 93.5% of the nitrogen in the feed gas is rejected in stream 33 with a loss of only 1% methane.

This example can be compared with the nitrogen removal process described in an article by R. C. Butts, et al, "Nitrogen-Rejection Process Developed for Small Fields", published in the *Oil & Gas Journal,* Mar. 13, 1995, pages 92–94. A conventional distillation process (described in more detail in U.S. Pat. Nos. 5,375,422 and 5,257,505) is utilized and requires about 1050 HP for the separation described above. Two compressors are required, as the feed gas must be compressed to 915 psia and a portion of the methane product gas must be recompressed to 290 psia. For the same separation, the process of the present invention as described in the Example above requires a methane product compressor of only 825 HP, and no feed gas compression is necessary. The methane compression requirement would be reduced to 650 HP if the methane product was vaporized and recovered at two pressure levels, at the expense of slightly more complexity in the heat exchangers. The process of the present invention therefore provides a 20 to 40% power savings compared with this particular prior art method, and is less expensive, easier to control, and more adaptable to a wide range of feed gas compositions.

This process can be used economically to process natural gas streams containing in excess of 5 mole % nitrogen such that these streams meet typical pipeline specifications for inert gas content. The process is particularly well-suited to gas flow rates of about 5 to 30 MM SCFD and can handle a wide range of inlet gas compositions and a wide range of inlet gas flow rates without complex and expensive distillation column systems, refrigeration cycles, and control systems.

The present process reduces both the capital cost and the power required to remove nitrogen from natural gas to produce a pipeline quality methane-rich natural gas product. The dephlegmator provides 5 to 15 theoretical stages of separation which are typically necessary to reject a high purity ($95^+$ mole %) nitrogen stream with minimal loss of methane with significantly less cost and complexity than conventional distillation or absorption processes. The overhead reflux condensers, reflux drums, piping and valves required for conventional distillation columns are all eliminated. The dephlegmator also requires less refrigeration power than a conventional distillation column because refrigeration is provided over the entire temperature range of the 5 to 15 rectification stages rather than only at the coldest temperature level as in a distillation column condenser. A multi-stage stripping heat exchanger, if required to increase methane product purity, is also less costly and more efficient than a conventional reboiled stripping column.

The entire process of cooling and rectifying the feed gas, stripping the methane-rich liquid product (if necessary), and providing all of the required refrigeration can be incorporated into a small number of heat exchangers to provide a highly cost effective and energy efficient process. All of the refrigeration required for the process is provided by pressure reduction of the methane-rich liquid stream and optional expansion of the nitrogen-rich gas stream. No external refrigeration, such as that provided by open- or closed-loop refrigeration cycles, is required. No cryogenic liquid pumps are required. The dephlegmator and the reboiler or multi-stage stripping heat exchanger, if required, are simple to control and less costly than distillation or absorption/stripping processes.

The essential characteristics of the present invention are described completely in the foregoing disclosure. One skilled in the art can understand the invention and make various modifications without departing from the basic spirit of the invention, and without deviating from the scope and equivalents of the claims which follow.

We claim:

1. A method for the removal of nitrogen from a pressurized feed gas mixture containing nitrogen and methane which comprises:

(a) cooling the feed gas mixture;

(b) introducing the resulting cooled feed gas mixture into a dephlegmator wherein the gas mixture is further cooled, partially condensed, and rectified to produce a nitrogen-rich overhead and a methane-rich bottoms;

(c) subcooling the methane-rich bottoms and reducing the pressure of the resulting subcooled stream;

(d) vaporizing the resulting reduced-pressure methane-rich stream in the dephlegmator by indirect heat exchange with the cooled feed gas mixture to provide at least a portion of the refrigeration required for cooling, partially condensing, and rectifying the cooled feed gas mixture in step (b); and (e) withdrawing from the dephlegmator an intermediate vaporized methane-rich stream.

2. The method of claim 1 wherein the pressure of the pressurized feed gas mixture is greater than about 250 psia.

3. The method of claim 1 wherein the pressurized feed gas mixture contains between about 5 and about 15 mole % nitrogen.

4. The method of claim 1 wherein the subcooling of the methane-rich bottoms in step (c) is accomplished at least in part by indirect heat exchange with the reduced-pressure methane-rich stream which is vaporized in the dephlegmator in step (d).

5. The method of claim 1 which further comprises reducing the pressure of the nitrogen-rich overhead and warming at least a portion of the resulting reduced-pressure nitrogen-rich stream in the dephlegmator to provide by indirect heat exchange a portion of the refrigeration required for cooling, partially condensing, and rectifying the cooled feed gas mixture in step (b), and withdrawing therefrom an intermediate nitrogen-rich stream.

6. The method of claim 5 wherein the intermediate nitrogen-rich stream is warmed by indirect heat exchange with the feed gas mixture of step (a), thereby providing a portion of the refrigeration required for cooling the feed gas mixture.

7. The method of claim 1 wherein the reduced-pressure methane-rich stream of step (d) is separated into an intermediate vapor and an intermediate liquid, and the intermediate liquid provides the portion of the resulting reduced-pressure methane-rich stream which is vaporized in step (d).

8. The method of claim 1 which further comprises warming the nitrogen-rich overhead by indirect heat exchange in the dephlegmator, work-expanding the resulting warmed stream to yield a cooled nitrogen-rich overhead, and warming the resulting work-expanded nitrogen-rich overhead by indirect heat exchange in the dephlegmator, thereby providing a portion of the refrigeration required for cooling, partially condensing, and rectifying the cooled feed gas mixture in step (b), and withdrawing therefrom an intermediate nitrogen-rich stream.

9. The method of claim 8 wherein the intermediate nitrogen-rich stream is warmed by indirect heat exchange with the feed gas mixture of step (a), thereby providing a portion of the refrigeration required for cooling the feed gas mixture.

10. The method of claim 1 wherein the intermediate vaporized methane-rich stream withdrawn from the dephlegmator in step (e) is warmed by indirect heat exchange with the feed gas mixture of step (a), thereby providing a portion of the refrigeration required for cooling the feed gas mixture.

11. The method of claim 1 wherein the methane-rich bottoms of step (b) is partially vaporized by indirect heat exchange with the cooled feed gas mixture of step (b) to yield a partially-vaporized methane-rich stream and a further cooled feed gas mixture, the partially-vaporized methane-rich stream is separated into a vapor fraction and a liquid fraction, the further cooled feed gas mixture and the vapor fraction are introduced into the dephlegmator, and the liquid fraction is subcooled according to step (c).

12. The method of claim 11 wherein the pressurized feed gas mixture contains between about 15 and about 30 mole % nitrogen.

13. The method of claim 1 wherein the methane-rich bottoms of step (b) is partially vaporized by indirect heat exchange with the cooled feed gas mixture of step (b) in a stripping heat exchanger in which the methane-rich bottoms is stripped to yield a further-enriched methane stream and an intermediate nitrogen-enriched vapor, wherein the cooled feed gas mixture is further cooled to yield an intermediate cooled feed gas mixture, the intermediate nitrogen-enriched vapor and the intermediate cooled feed gas are introduced into the dephlegmator, and the further-enriched methane stream is subcooled according to step (c).

14. The method of claim 13 wherein the pressurized feed gas mixture contains greater than about 30 mole % nitrogen.

15. Apparatus for the removal of nitrogen from a pressurized feed gas mixture containing nitrogen and methane which comprises:

(a) heat exchange means for cooling the feed gas mixture;

(b) a dephlegmator including a first flow passage for further cooling, partially condensing, and rectifying the resulting cooled feed gas mixture from the heat exchange means to produce a nitrogen-rich overhead stream and a methane-rich bottoms and means for introducing the cooled feed gas mixture into the first flow passage;

(c) means for withdrawing the methane-rich bottoms from the dephlegmator, means for subcooling the methane-rich bottoms, and means for reducing the pressure of the resulting subcooled stream;

(d) a second flow passage in the dephlegmator for vaporizing the reduced-pressure subcooled methane-rich stream, wherein the second flow passage is in indirect heat exchange contact with the first flow passage, and means for introducing the resulting reduced-pressure subcooled methane-rich stream into the second flow passage;

(e) means for withdrawing from the second flow passage an intermediate vaporized methane-rich stream; and (f) means for withdrawing from the first flow passage the nitrogen-rich overhead.

16. The apparatus of claim 15 which further comprises means for reducing the pressure of the nitrogen-rich overhead, a third flow passage in the dephlegmator for warming at least a portion of the resulting reduced-pressure nitrogen-rich stream, wherein the third flow passage is in indirect heat exchange contact with the first and second flow passages, means for introducing the reduced-pressure nitrogen-rich stream into the third flow passage, and means for withdrawing an intermediate nitrogen-rich stream from the third flow passage.

17. The apparatus of claim 15 wherein the means for subcooling the methane-rich bottoms comprises a fourth flow passage which is in indirect heat exchange contact with the first, second, and third flow passages of the dephlegmator.

18. The apparatus of claim 15 which further comprises heat exchange means to partially vaporize the methane-rich bottoms by indirect heat exchange with the cooled feed gas mixture, separator means to separate the resulting partially vaporized methane-rich bottoms into a vapor fraction and a liquid fraction, means to transfer the vapor fraction from the separator means into the first flow passage of the dephlegmator, and means to transfer the liquid fraction from the separator means into the fourth flow passage of the dephlegmator.

19. The apparatus of claim 15 which further comprises stripping heat exchange means wherein the methane-rich bottoms is partially vaporized and stripped by indirect heat exchange with the cooled feed gas mixture to yield a further-enriched methane liquid and an intermediate nitrogen-enriched vapor, means to transfer the further-enriched methane liquid from the stripping heat exchange means into the fourth flow passage of the dephlegmator, and means to transfer the intermediate nitrogen-enriched vapor from the stripping heat exchange means into the first flow passage of the dephlegmator.

* * * * *